US007714791B2

(12) United States Patent
Lavedas

(10) Patent No.: US 7,714,791 B2
(45) Date of Patent: May 11, 2010

(54) ANTENNA WITH IMPROVED ILLUMINATION EFFICIENCY

(75) Inventor: Thomas G. Lavedas, Clifton, VA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 12/166,399

(22) Filed: Jul. 2, 2008

(65) Prior Publication Data

US 2010/0001914 A1 Jan. 7, 2010

(51) Int. Cl.
*H01Q 11/12* (2006.01)

(52) U.S. Cl. ..... 343/742

(58) Field of Classification Search ..... 343/741, 343/742, 866, 867, 788
See application file for complete search history.

(56) References Cited

U.S. PATENT DOCUMENTS

| | | | |
|---|---|---|---|
| 3,774,221 | A | 11/1973 | Francis |
| 3,823,403 | A | 7/1974 | Walter et al. |
| 4,160,978 | A | 7/1979 | DuHamel |
| 4,375,289 | A | 3/1983 | Schmall et al. |
| 4,680,591 | A | 7/1987 | Axford et al. |
| 4,791,285 | A | 12/1988 | Ohki |
| 5,221,902 | A | 6/1993 | Jones et al. |
| 5,237,165 | A | 8/1993 | Tingley, III |
| 5,459,451 | A | 10/1995 | Crossfield et al. |
| 5,602,556 | A | 2/1997 | Bowers |
| 5,903,242 | A | 5/1999 | Tsuru et al. |
| 5,945,958 | A | 8/1999 | Staufer et al. |
| 6,814,284 | B2 | 11/2004 | Ehlers et al. |
| 6,825,754 | B1 | 11/2004 | Rolin |

(Continued)

FOREIGN PATENT DOCUMENTS

JP 11 313017 A 11/1999

(Continued)

OTHER PUBLICATIONS

Andre Kurs, Wireless Power Transfer Via Strongly Coupled Magnetic Resonances, Science, Jul. 6, 2007, pp. 83-86, vol. 317.

(Continued)

*Primary Examiner*—Michael C Wimer
(74) *Attorney, Agent, or Firm*—Daly, Crowley, Mofford & Durkee, LLP

(57) ABSTRACT

An antenna is provided including a first loop having at least one first conductor and a second loop having at least one second conductor, the second conductor connected to the first conductor. The first loop has a first enclosed area defined by the area inside the perimeter of the first loop and a first phase center point defined by the geometric center point of the first enclosed area. The second loop is coupled to the first loop and is disposed a distance from and substantially parallel to the first loop. The second loop has a second enclosed area substantially equal to the first enclosed area and a second phase center point. A line normal to the plane of the first loop passes through the first and second phase center points. The first and second loops are disposed to substantially reduce the far-field illumination, while substantially maintaining the near-field illumination at effective radio frequency identification system operational levels. The antenna may be used to energize devices through inductive coupling.

15 Claims, 14 Drawing Sheets

U.S. PATENT DOCUMENTS

| | | | |
|---|---|---|---|
| 7,215,293 | B2 | 5/2007 | Chen et al. |
| 2003/0197653 | A1 | 10/2003 | Barber et al. |

FOREIGN PATENT DOCUMENTS

| | | | |
|---|---|---|---|
| WO | WO 2006/107862 | A2 | 10/2006 |

OTHER PUBLICATIONS

Notification of Transmittal of the International Search Report and the Written Opinion of the International Searching Authority, or the Declaration PCT/US2009/049136 dated Aug. 4, 2009, 3 pages.
International Search Report, PCT/US2009/049136 dated Aug. 4, 2009, 4 pages.
Written Opinion of the International Searching Authority, PCT/US2009/049136 dated Aug. 4, 2009, 8 pages.

ANTENNA WITH IMPROVED ILLUMINATION EFFICIENCY

FIELD OF THE INVENTION

This invention generally relates to an antenna structure that provides reduced far-field radiation for an equivalent near field illumination for the activation of radio frequency identification tags. In particular, the antenna structure provides parallel radiators opposed in polarity to improve antenna efficiency and increase the useful range and area of coverage within the limitations imposed by various governmental RF emission rules. Furthermore, the antenna structure can efficiently use near-field inductive-coupling to energize remote devices.

BACKGROUND

Radio frequency identification (RFID) systems operating in the high-frequency range, typically at 13.56 Megahertz (MHz), are radiation limited by governmental regulations, such as the Federal Communications Commission (FCC) rules governing the industrial, scientific, and medical (ISM) operating bands commonly used for these unlicensed systems, in particular 47CFR15.225. These RFID systems are commonly known as vicinity readers because they are capable of reading credit card sized RFID tags to a distance of 60 centimeters (about two feet).

As is known in the art, antenna systems have near-field and far-field radiation regions. The near field is a region near an antenna where the angular field distribution depends upon the distance from the antenna. The near field is generally within a small number of wavelengths from the antenna and is characterized by a high concentration of energy and energy storage in non-radiating fields. In contrast, the far field is the region outside the near field, where the angular distributions of the fields are essentially independent of the distance from the antenna. Generally, the far-field region is established at a distance of greater than $D^2/\lambda$ from the antenna, where D is an overall dimension of the antenna that is large compared to wavelength $\lambda$. The far-field region is where radiation from the antenna is said to occur.

RFID systems use near fields for communications between the RFID tag and the RFID interrogator. Also, the energy stored in the near fields provides the power to drive a microchip imbedded in a passive RFID transponder tag. Many conventional RFID systems use loop-type radiators for interrogator antennas, for example, an antenna consisting of a figure-eight shaped conductor.

Conventional RFID systems are being increasingly used to enhance supply chain activities, security, and a myriad of other applications and industries. However, conventional RFID systems often have limited operating ranges, which limits their usefulness. Attempts to increase RFID system range, however, often result in the need for increasing input power, which violates FCC radiation limitations, generally because of proportional increases in far-field radiation.

It would, therefore, be useful to provide a RFID system that can increase near fields while simultaneously reducing far-field radiation. Such a RFID system would have an increased operating range while abiding by applicable governmental RF radiation regulations.

SUMMARY

In accordance with the present invention, an antenna comprises a first loop having at least one first conductor, the first loop having a first enclosed area defined by the area inside the perimeter of the first loop and having a first phase center point defined by the geometric center point of the first enclosed area; and a second loop having at least one second conductor, the at least one second conductor connected to the at least one first conductor, the second loop disposed a distance from and substantially parallel to the first loop, the second loop having a second enclosed area substantially equal in size to the first enclosed area and having a second phase center point, wherein a current supplied to the first and second loops is of equal magnitude and opposite polarity in the respective first and second loops. A line normal to the plane of the first loop passes through the first and second phase center points.

In another aspect of the present invention, an antenna comprises a first loop having at least one first conductor, the first loop having a first enclosed area defined by the area inside the perimeter of the first loop and having a first phase center point defined by the geometric center point of the first enclosed area; a second loop having at least one second conductor, coupled to the first loop and disposed a distance from and substantially parallel to the first loop, the second loop having a second enclosed area substantially equal in size to the first enclosed area; and an outer loop coupled to the first and second loops, the first and second loops having a total enclosed area equal to the sum of the first and second enclosed areas, and the outer loop substantially parallel to the first loop and having an outer enclosed area equal to the total enclosed area and an outer phase center point, wherein a current supplied to the antenna flows in a first polarity and has a first magnitude in the outer loop and flows in a second polarity and has a second magnitude in the first and second loops, the first and second polarities opposite to each other, and the first and second magnitudes equal to each other. A line normal to the plane of the first loop passes through the first loop, second loop, and outer loop phase center points.

With this particular arrangement, an antenna radiates power that is substantially cancelled in the far-field radiation region while being substantially maintained or increased in the near-field region. In this way, the antenna can extend the operating range of RFID systems and, therefore, the usefulness of RFID systems.

In one application, a RFID transponder can incorporate the antenna to extend the distance at which RFID tags can be reliably detected and identified. For example, the antenna can extend the operating range of systems using credit card sized RFID tags. In another application, the antenna is configured to be mountable in a low-profile environment, such as a ceiling or wall space, furniture, and other devices. A device may be positioned to maximize an amount of energy received from the antenna via inductive coupling. For example, a device may be positioned on a table top directly beneath the antenna mounted behind a ceiling tile.

BRIEF DESCRIPTION OF THE DRAWINGS

The foregoing features of the antenna, techniques, and concepts described herein, may be more fully understood from the following description of the drawings in which.

DETAILED DESCRIPTION

Figure 1:
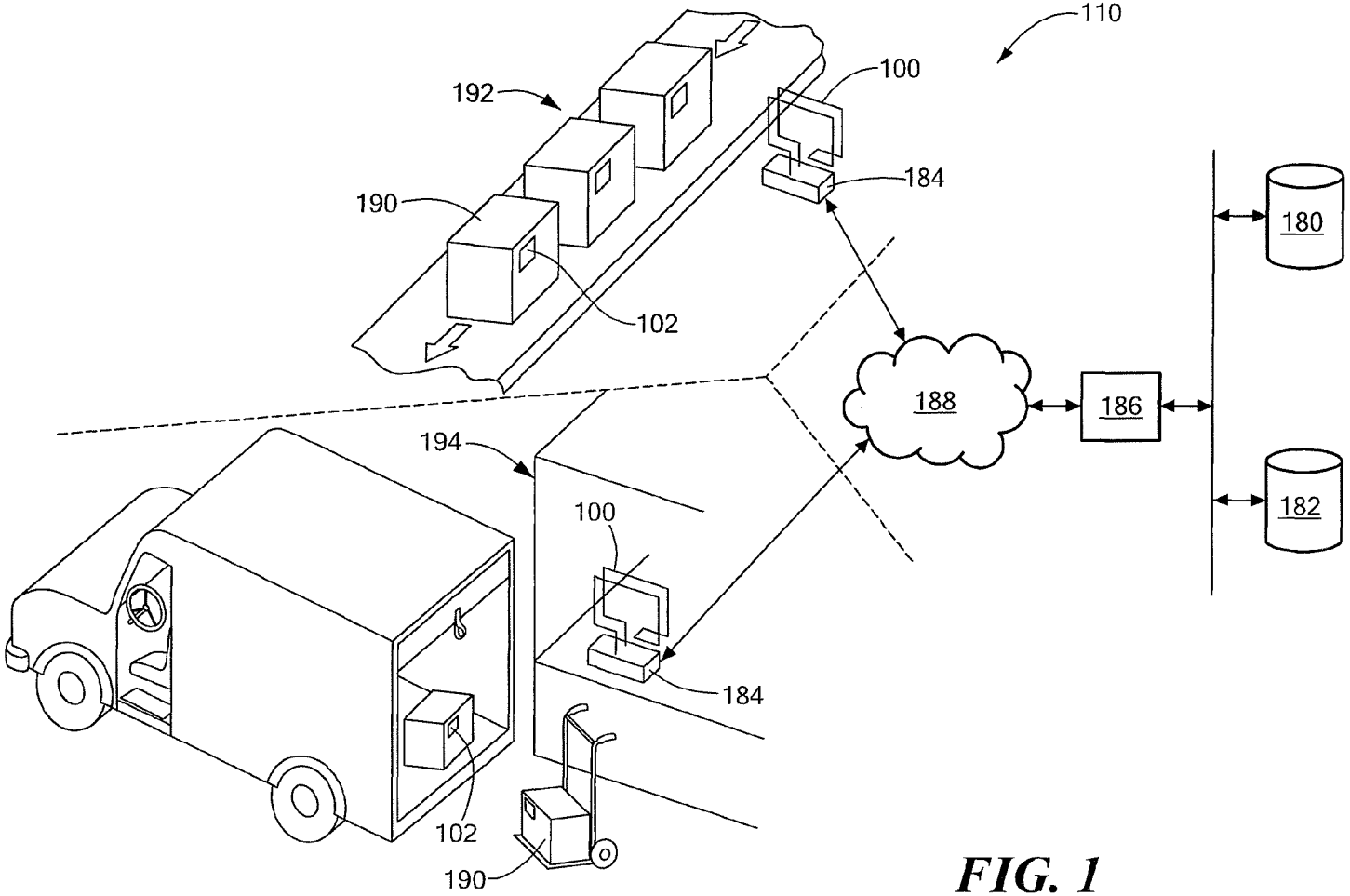
FIG. 1 is a pictorial view of a supply chain and inventory tracking environment using an RFID system.

Referring to FIG. 1, a supply chain and inventory tracking environment in which an embodiment of the antenna 100 operates is shown. Inventory 190 may be boxed and labeled with an RFID tag 102 having a unique ID number for the inventory 190. The unique ID number may be stored in an inventory database 180. As the inventory 190 moves through the supply chain, a RFID system 110 tracks and records inventory location in an inventory tracking database 182.

The RFID system 110 includes RFID tags 102 and RFID stations 184 having interrogators for radio communications with the tags. As a RFID tag 102 comes into operating range of a RFID station 184, an initiate-communications signal may be transmitted from the RFID station 184 via a station antenna 100. A receiver/transmitter on each of the RFID tags 102 responds to the initiate-communications signal by sending the tag's unique ID number to the RFID station 184, which is received at the antenna 100. The RFID system 110 may include authentication signals and may provide power to passive RFID tags 102.

The antenna 100 may be located at various points along the supply chain to monitor advancements of inventory 190. For example, the antenna 100 may be located along a factory conveyor belt 192 or loading dock 194. The RFID station 184 may be coupled to an inventory tracking server 186 over a network 188. As the inventory 190 advances through the supply chain 192, 194, the RFID system 110 identifies pieces of inventory 190 by reading the unique ID number stored on the RFID tags 102 and tracks inventory location, which may be based on a location of an RFID station 184 currently reading the tags 102. The RFID system 110 may send inventory attributes and location information over the network 188 to the RFID tracking server 186, which may update the inventory tracking database 182.

Figure 2:
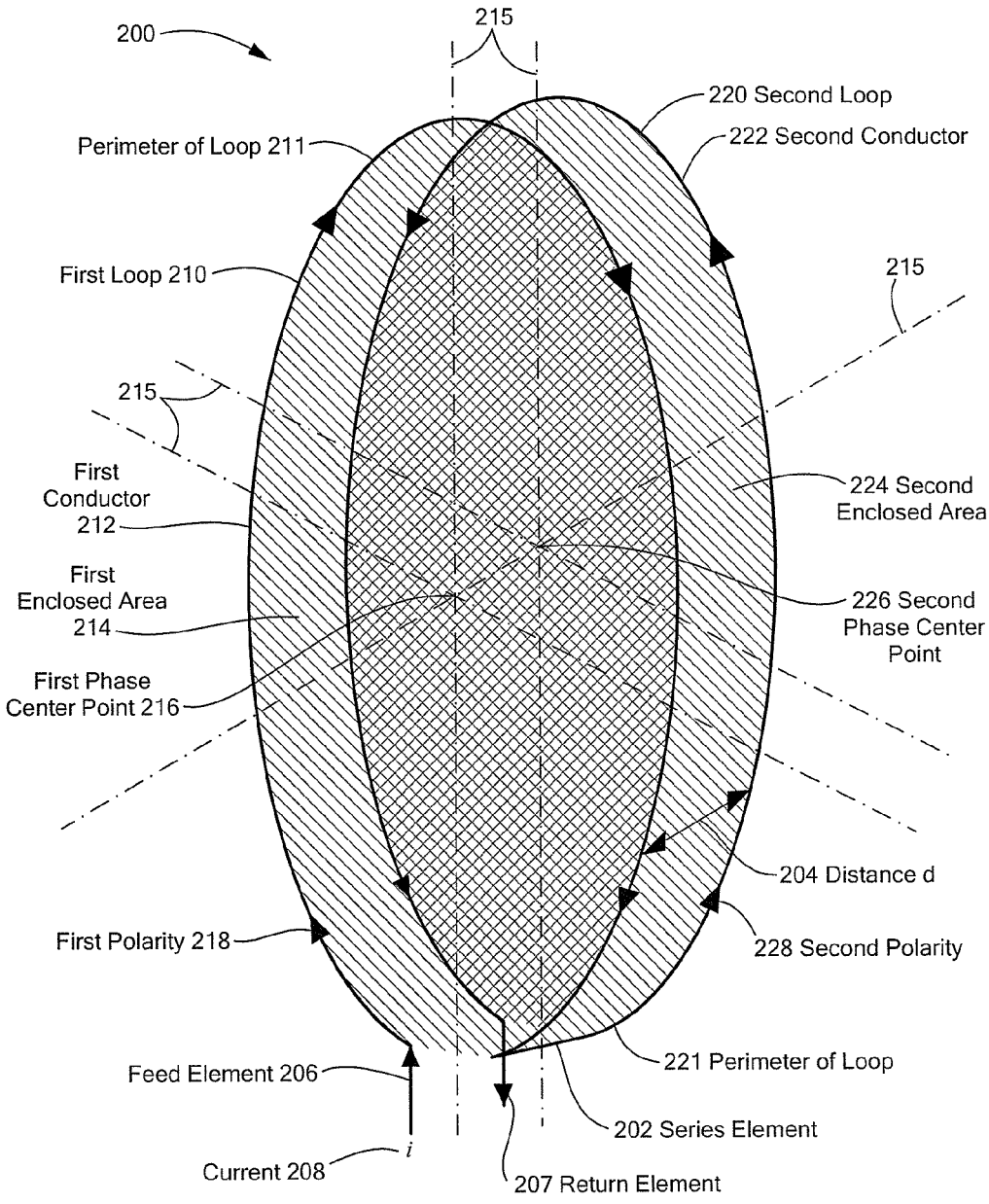
FIG. 2 is a pictorial view of an embodiment of an antenna of the invention.

Referring to FIG. 2, an antenna 200 includes a first loop 210 and a second loop 220. The first loop 210 includes at least one first electrical conductor 212 and has a first enclosed area 214 defined by an area inside the perimeter 211 of the first loop 210. The first loop 210 has a first phase center point 216 defined by the geometric center point of the first loop 210. A phase center point refers to the location from which phase is measured such that the electromagnetic fields spread spherically outward, with the phase of the signal being equal at any point on the sphere.

The second loop 220 includes at least one second electrical conductor 222 coupled to the at least one first electrical conductor 212 and has a second enclosed area 224 defined by an area inside the perimeter 221 of the second loop 220. The second loop 220 has a second phase center point 226 defined by the geometric center point of the second loop 220.

The first and second loops 210, 220 are placed a distance s 204 apart and are substantially parallel to each other. Furthermore, the first and second enclosed areas 214, 224 are substantially equal in area to each other and the first and second phase center points 216, 226 are substantially coincident with a line normal to them that passes through their geometric centers, as shown by the dotted lines designated by reference numeral 215.

Preferably, a feed element 206 feeds a current 208 to the first and second loop 210, 220. The feed element 206 may be coupled to an electric circuit for generating the current 208. A return element 207 is also provided to return the current to, for example, the electric circuit.

The feed element 206 feeds the current 208 in a first polarity 218 to the first loop 210. Polarity refers to a direction of current flow in a conductor. The current 208 traverses to the second loop 220 through a series element 202. The series element 202 feeds the current 208 to the second loop 220 in a second polarity 228. The second polarity 228 is opposite to the first polarity 218.

With this configuration, an antenna 200 composed of two equal-sized, coincident loops positioned parallel to each other and spaced, for example, several inches apart, produces two substantially equivalent radiation fields. However, the current flow in the two loops is in opposition and slightly offset spatially. The opposition leads to the substantial reduction in experienced far-field power. This is because the far fields from the two loops are substantially identical and in opposition to each other at a great distance from the two loops, differing by only a small amount of phase in some directions. Further, in the particular directions where the maximum phase difference occurs, the individual loops do not radiate due to the loop geometries. At the point of greatest radiation experienced in a cone having an apex angle of 45 degrees centered on the normal to the planes of the loops, the directivity of the loops results in an additional far-field reduction effect of two (−3 decibels).

In the vicinity of the loops, the fields are not uniform, but vary significantly as a function of distance from each loop. This variation is substantially inversely proportional to the third power of the distance from each loop. Therefore, fields created by loops separated by only a small distance can result in a significant difference in strength. This effect causes the loop fields to differ significantly from each other at all locations of interest close by the antenna 200. Thus, the summing of the fields does not result in a substantial reduction in the total field in this region. Further, because substantially less of the energy delivered to the antenna 200 escapes as far-field radiation, the antenna 200 is more efficient. This is especially important as antenna 200 size is increased to further extend communications range to the RFID tags. In this way, the antenna 200 can increase RFID system operating range while maintaining compliance with applicable governmental RF radiation regulations.

The antenna 200 may be defined by a single conductive element having different portions making up, in succession, the feed element 206, the first loop 210, the series element 202, and the second loop 220. In this configuration, the series element 202 can extend perpendicularly from the first loop 210, and can couple perpendicularly to the second loop 220. In this way, the first and second loops 210, 220 are configured to be parallel to each other, and spaced a distance apart from each other that is equal to the length of the interconnecting series element 202.

The antenna 200 may be configured to interoperate with various types of RFID tags. For example, the antenna 200 may supply radiated power to a passive RFID tag. In another configuration, the RFID tag may be semi-passive in that the RFID tag is battery-powered instead of inductively powered, while the RFID tag modulates the incident RF energy to communicate with the interrogating device. For example, the RFID chip may be battery powered while the RFID transmitter may modulate the incident RF field. In still another configuration, the RFID tag is an active RFID tag driven by battery power and responding with an RF field created by the RFID tag.

Figure 3:
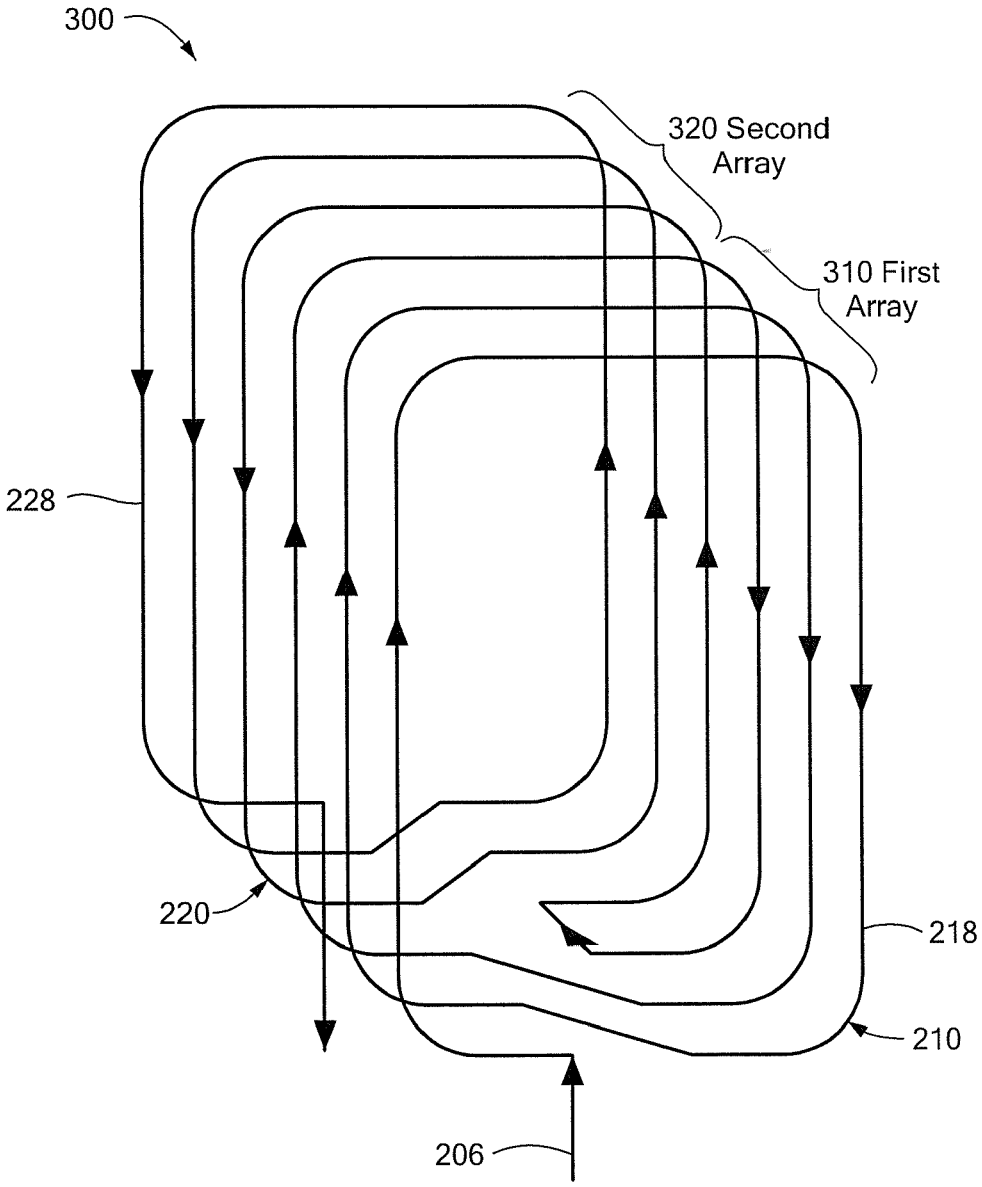
FIG. 3 is a pictorial view of an alternative embodiment of the antenna shown in FIG. 2.

Referring now to FIG. 3, in which like elements of FIG. 2 are provided having like reference designations, a further embodiment of the antenna 300 includes a first array of first loops 310 and a second array of second loops 320. Each of the first and second arrays 310, 320, may include two or more respective first and second loops 210, 220. The feed element 206 supplies a current in a first polarity 218 to the first array 310 and in a second polarity 228 to the second array 320. The first and second polarities 218, 228 are opposite of each other.

Figure 4:
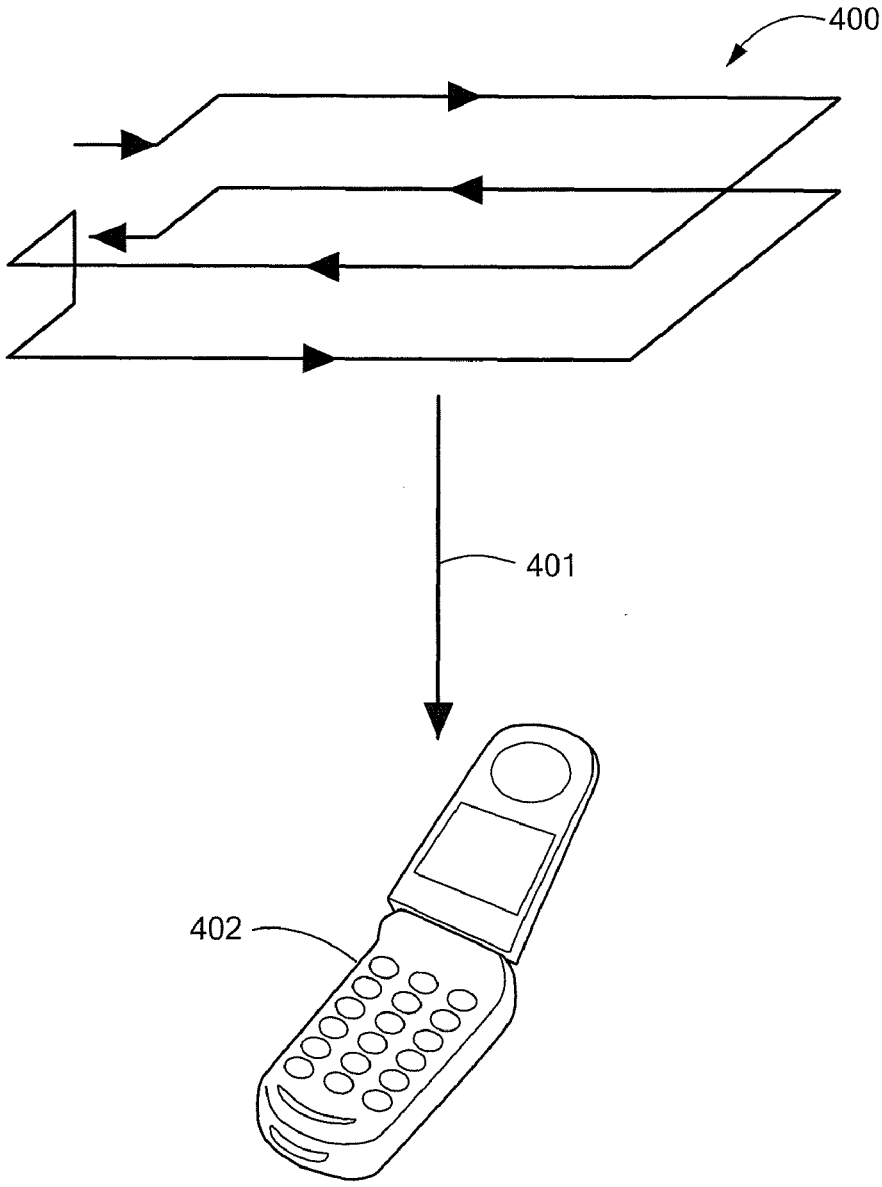
FIG. 4 is a pictorial view of an embodiment of the antenna of the invention for energizing a device.

Referring to FIG. 4, the antenna 400 is configured to energize a device 402 through inductive coupling, as shown by the line designated by reference numeral 401. The device 402 can include, but is not limited to, a cell phone, a laptop, a handheld game unit or other electronic device. The term energize includes providing instantaneous energy to the device 402 to enable use of the device 402, for example, providing instantaneous energy to a smart phone during a call or to read email on the smart phone. Energize also includes providing energy over time to recharge a device's energy storage cell, for example, recharging a cell phone battery. A battery includes, but is not limited to, rechargeable electrochemical cells, also known in the art as secondary cells, for example, NiCd, NiMH, and rechargeable alkaline batteries. Other energy storage cells include those used to power electric vehicles.

In one environment, the antenna 400 is configured to be mountable in a low-profile environment, such as a ceiling or wall space, furniture, and other devices. The device 402 may be positioned to maximize an amount of energy received from the antenna 400 via inductive coupling. For example, the device 402 may be positioned on a table top directly beneath the antenna 400 mounted behind a ceiling tile.

Figure 5:
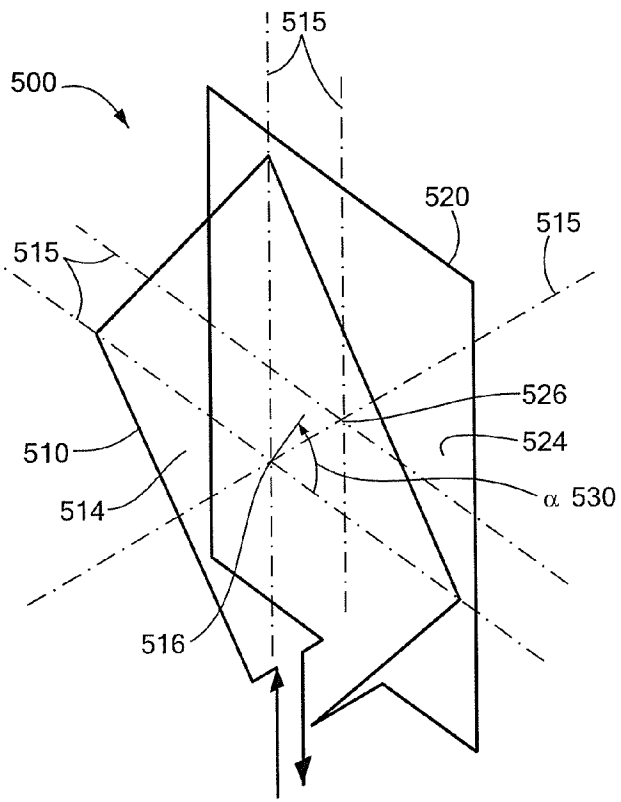
FIG. 5 is a pictorial view of an alternative embodiment of the antenna shown in FIG. 2.

Referring to FIG. 5, in another embodiment of the antenna 500, the first and second loops 510, 520 have equal enclosed areas 514, 524, and coincident phase center points 516, 526 (as shown by dotted lines designed by reference numeral 515), but are offset from each other at an angle of rotation a about the phase center points in the parallel planes of the loops. For example, as some in FIG. 5, the first and second loops 510,520 may be offset 45° from each other about their respective phase center points 514, 524.

Referring again to FIG. 5, the first and second loops 510, 520 are both square-shaped, however, the first and second loops 510, 520 need not have the same overall shape, as long as the enclosed areas are equal and the phase center points are coincident. For example, one of the loops may be oval-shaped, and the other of the loops may be square-shaped.

Figure 6:
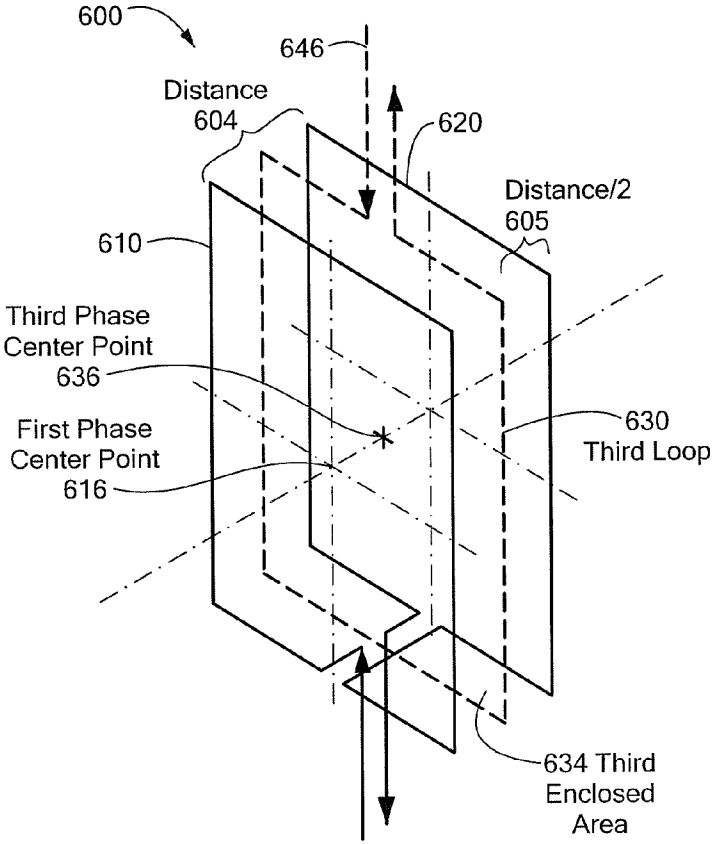
FIG. 6 is a pictorial view of a further embodiment of the antenna shown in FIG. 2.

Referring to FIG. 6, an alternative embodiment of the antenna 600 includes a third loop 630. The third loop 630 is substantially parallel to and disposed midway between the first and second loops 610, 620. For example, if the first and second loops 610, 620 are disposed a distance s 604 from each other, the third loop 630 would be disposed a distance s/2 605 from each of the loops.

Furthermore, the third loop 630 has a third enclosed area 634 substantially equal to the first enclosed area 614, and a third phase center point 636 coincident to the first phase center point 616. The third loop 630 may be configured as a receiving component of the antenna 600, whereas the first and second loop 610, 620 are transmitting components of the antenna 600.

With this configuration, the antenna 600 has a transmit and receive mode. One advantage of this configuration is that the wave patterns of the first and second loops 610, 620 will cancel each other at the vicinity of the third loop 630. A second isolated feed 646 can be provided to the system receiver by the third loop 630. The isolated feed 646 can be used to improve the isolation of the receive channel from the transmit channel of an antenna system to further improve operating range. In particular, as the range over which the RFID tag can be powered is increased; the sensitivity of the receiver must increase nearly proportionally. The sensitivity of the receive channel is dependent upon its ability to differentiate the very low power of the RFID tag's response from the very high power of the interrogating transmit signal. A substantial portion of this ability is provided by the frequency separation between the interrogation and response signals. However, substantially greater sensitivity is achievable with the addition of the frequency independent isolation provided by the geometry of the antenna 600.

Figure 7:
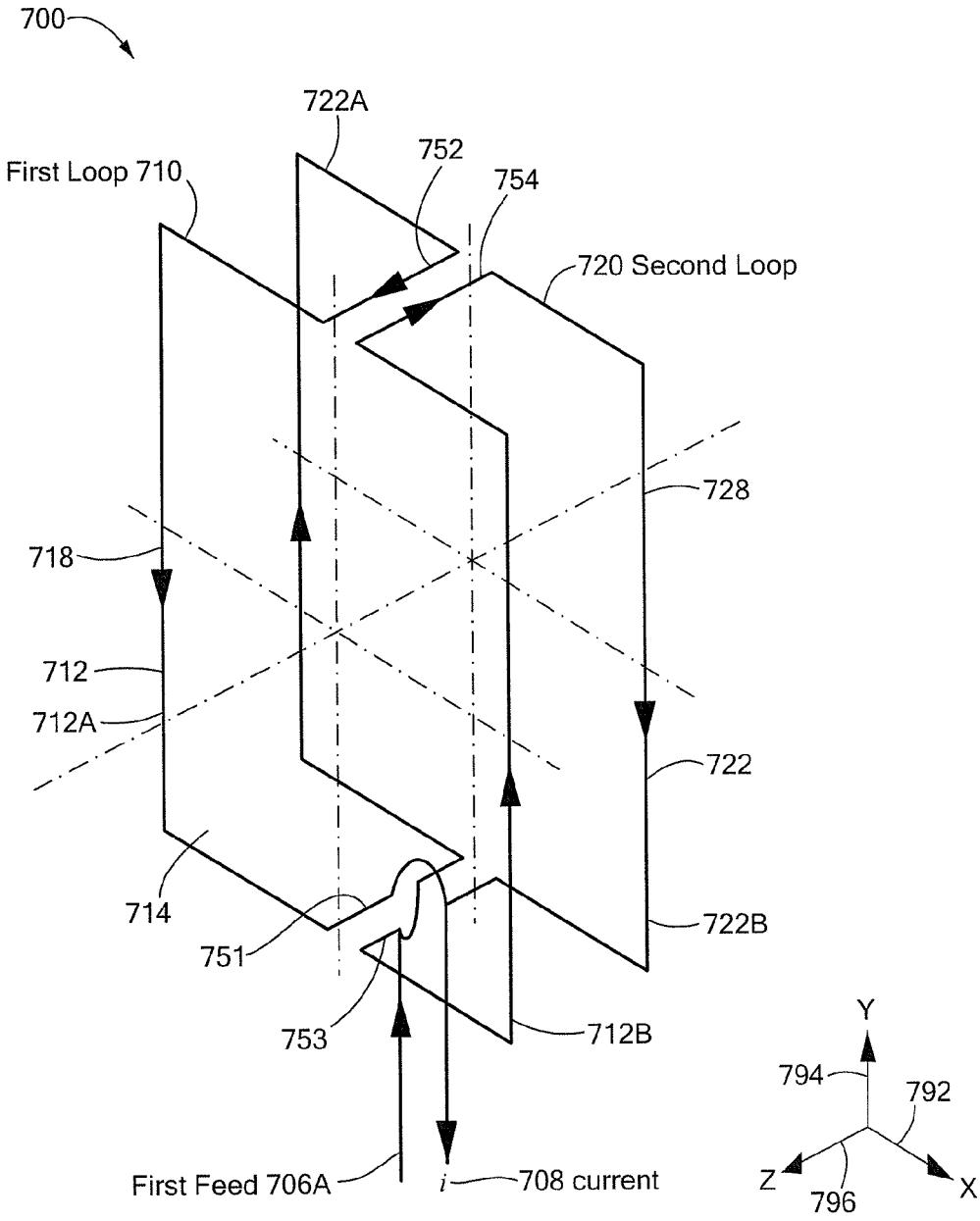
FIG. 7 is a pictorial view of an alternative embodiment of the antenna shown in FIG. 2.

Referring now to FIG. 7, in another embodiment of the antenna 700, at least one first conductor 712 of a first loop 710 includes a first and second conductor portion 712A, 712B. Also, at least one second conductor 722 of a second radiator 720 includes a third and fourth conductor portion 722A, 722B. The first and second loops 710, 720 are coupled using a series of joining elements 751, 752, 753, 754 forming dual u-shaped structures when viewed orthogonally to an x-z plane formed by an x-dimension 792 and a z-dimension 796. The first and second loops 710, 720 extend in a y-dimension 794. The dual u-shaped structures are adjacent to each other at the series of joining elements 751, 752, 753, 754, which extend in the z-dimension 796.

The first and third conductor portions 712A, 722A may be coupled to each other at opposing sides of the antenna 700 via a first joining element 751 and a second joining element 752. Also, the second and fourth conductor portions 712B, 722B are coupled to each other at opposite ends via a third joining element 753 and a forth joining element 754. The first and third joining elements 751, 753 are adjacent to each other and coupled to a first feed 706A. The first feed 706A supplies a current 708 to the antenna 700 in a first polarity 718 through second portion 712B of first loop 710 and in a second polarity 728 through third portion 722A in second loop 720. The first and second polarities 718, 728 are opposite to each other. The second and fourth joining elements 752, 754 are adjacent to each other. The second joining element 752 supplies the current 708 in the first polarity 718 through first portion 712A of the first loop 710. The fourth joining element 754 supplies the current 708 in the second polarity 728 through forth portion 722B of the second loop 720. The loops of antenna 700 are comprised of disjoint portions which carry current 708 at the same polarity, forming a singular enclosed area. For example, the first loop 710 is comprised of disjoint first and second portions 712A, 712B which carry the current 708 at a first polarity 718 and form the first enclosed area 714.

Figure 8:
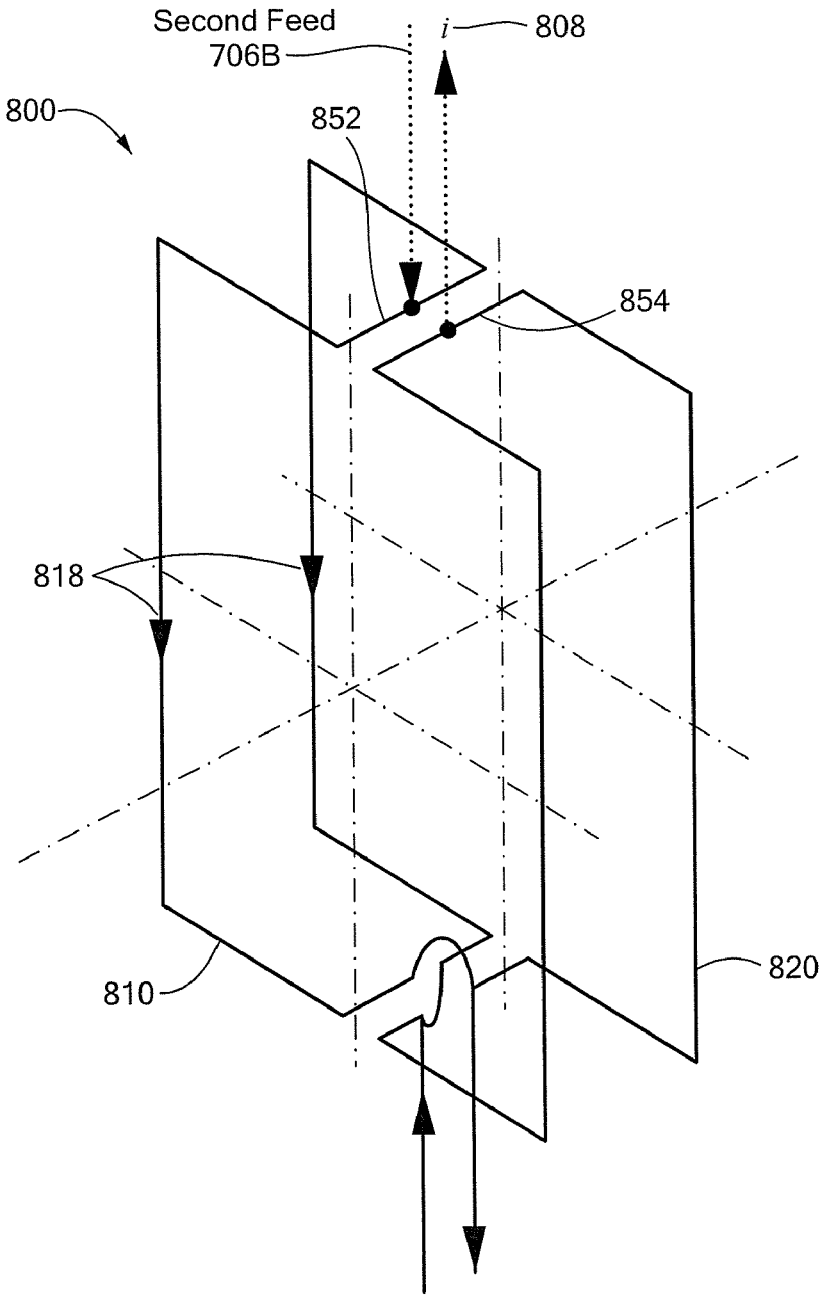
FIG. 8 is a pictorial view of a further embodiment of the antenna shown in FIG. 7.

Referring now to FIG. 8, antenna 800 has a transmit mode and a receive mode and further includes a second feed 706B that is coupled to a second joining element 852 and a fourth joining element 854. Second feed 706B supplies a receiver current 808 of the same polarity 818 to the first and second loops 810, 820.

Figure 9:
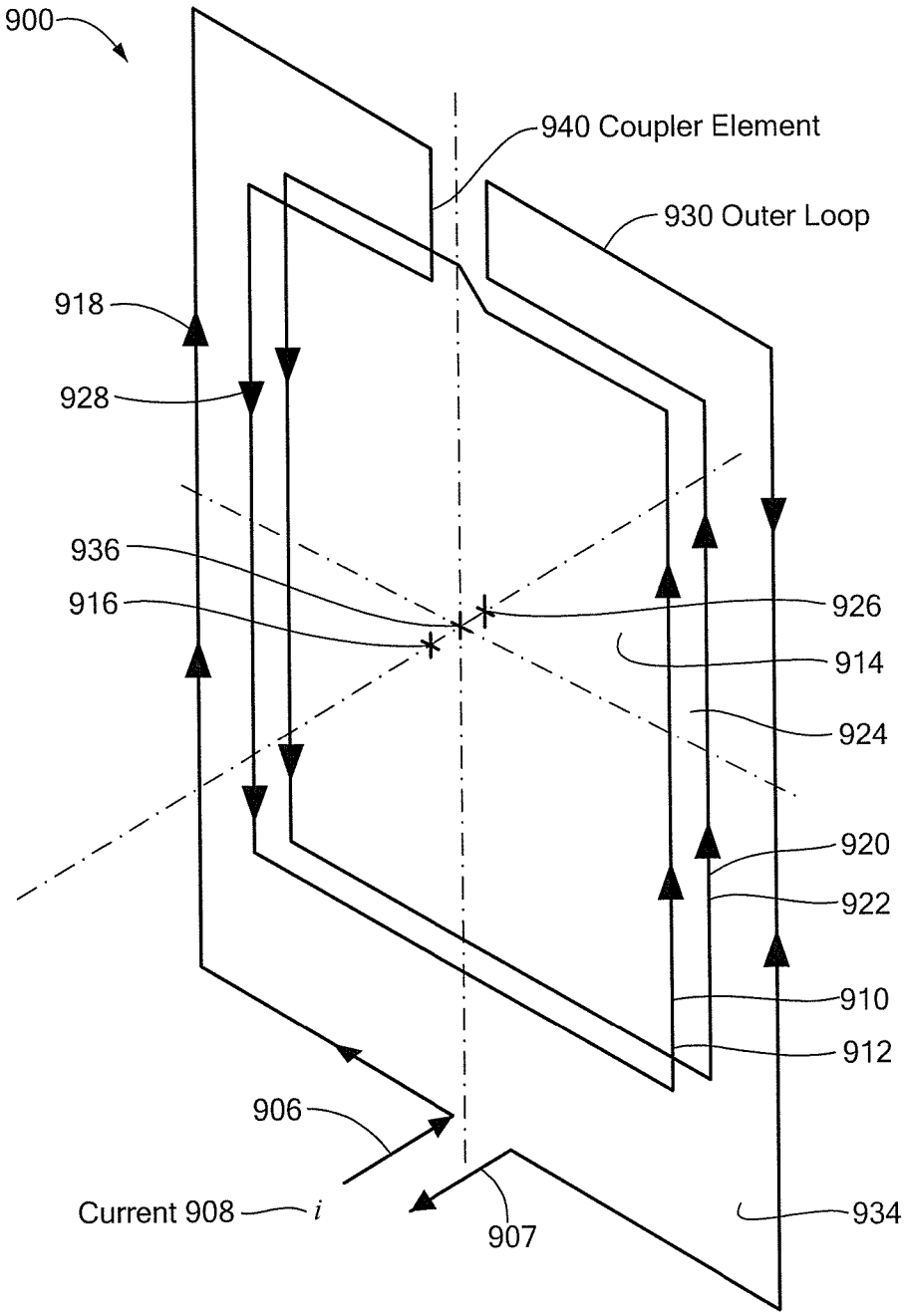
FIG. 9 is a pictorial view of an alternative embodiment of an antenna of the invention.

Referring to FIG. 9, in another embodiment, the antenna 900 includes a first loop 910 including at least one first conductor 912, a second loop 920 including at least one second conductor 922, and an outer loop 930 coupled to the first and second loops 910, 920. The first loop 910 has a first enclosed area 914 defined by the area inside the perimeter of the first loop 910 and a first phase center point 916 defined by the geometric center point of the first enclosed area 914.

The second loop 920 is coupled to the first loop 910 and disposed adjacent to and substantially parallel to the first loop 910. The second loop 920 has a second enclosed area 924 substantially equal to the first enclosed area 914 and a second phase center point 926. A line normal to the plane of the first loop 910 passes through the first phase center point 916 and the second center point 926.

The outer loop 930 is substantially parallel to the first loop 910 and has an outer enclosed area 934 equal to the sum of the first and second enclosed areas 914, 924. The outer loop 930 also has an outer phase center point 936 coincident to the first phase center point 916. The antenna 900 may further include a coupler element 940 to couple the outer loop 930 to one of the first and second loops 910, 920. Also, a feed element 906 supplies a current 908 in a first polarity 918 to the outer loop 930 and the coupler element 940 supplies the current 908 in a second polarity 928 to the one of the first and second loops 910, 920. The second polarity 928 is opposite to the first polarity 918. Optionally, a return element 907 is included to return the current 908 to, for example, an electric circuit.

With this configuration, characterized by an outer loop surrounding inner loops, the outer loop having an outer loop enclosed area equal in size to the sum of each of the inner loop enclosed areas, the far-field radiation is cancelled to a high degree, while the near-field energy is not as substantially impacted. Far-field radiation cancellation is dependent on the inner loops having substantially equal enclosed areas. The inner loops produce a substantially higher near-field energy peak along the axis coincident to the inner loops. Thus, the reduction in the near-field energy is not complete. Rather, a usable level of near-field energy can be produced at greater distances from the antenna 900 while maintaining radiation levels low enough to satisfy prevailing governmental RF radiation regulations.

In addition, the cancellation of the far-field results in higher system efficiency. The only limitation on RFID operating range is the accuracy of the sizing, the relative placement, and the orientation of the inner and outer loops such that respective enclosed areas are equal and phase center points coincident.

The antenna 900 can achieve far-field radiation cancellation on the order of 30 to 40 dB. The comparable reduction in the near-field is about two orders of magnitude less, leading to a 20 to 30 dB improvement in operating range. Generally, RFID system applications require an 18 dB improvement to realize a doubling of operating range. Thus, the antenna 900 can enhance operating ranges to values two or even three times that in the current state-of-the-art RFID systems.

Figure 10C:
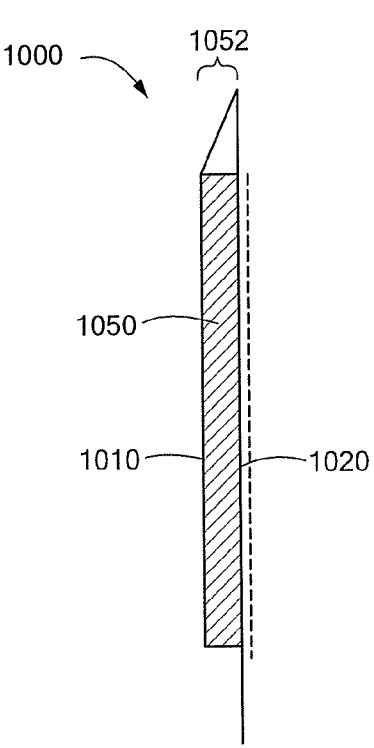
FIG. 10C is a side view of a further embodiment of the antenna in FIG. 9 having an insulation layer.
Figure 10B:
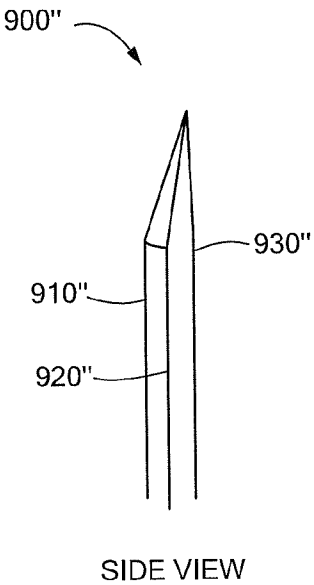
FIG. 10B is a side view of a further embodiment of the antenna in FIG. 9 having the inner loops on the same side of the outer loop.
Figure 10A:
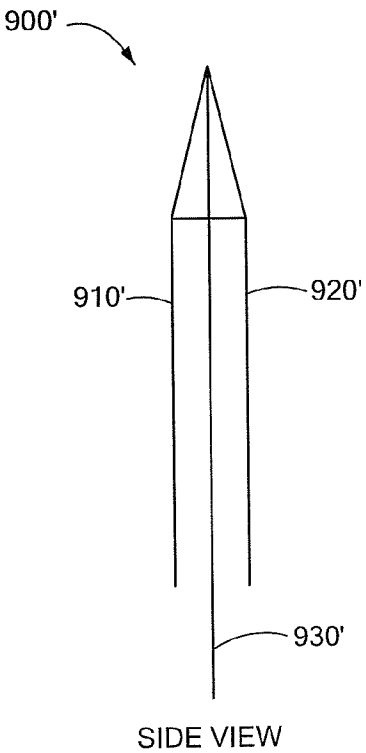
FIG. 10A is a side view of a further embodiment of the antenna shown in FIG. 9 having the inner loops on opposing sides of the outer loop.

Referring to FIG. 10A showing a side view of the antenna 900', the first and second loops 910', 920' may be disposed on opposites sides of the plane formed by the outer loop 930'. Alternatively, as shown in FIG. 10B, the first and second loops 910", 920" of the antenna 900" may be disposed on the same side of the plane formed by the outer loop 930".

Referring to FIG. 10C, the antenna 1000 can further include an electrically insulating material 1050 to insulate the first and second loops 1010, 1020 from each other to minimize an overall thickness 1052 of the antenna 1000. With this configuration, the antenna 1000 can be made as thin as possible for mounting in narrow spaces behind walls, floors, ceilings, etc.

Figure 11B:
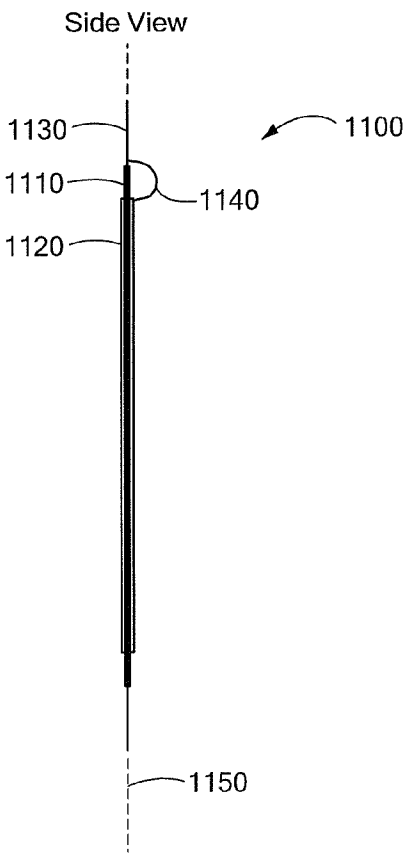
FIG. 11B is a side view of the antenna shown in FIG. 11A.
Figure 11A:
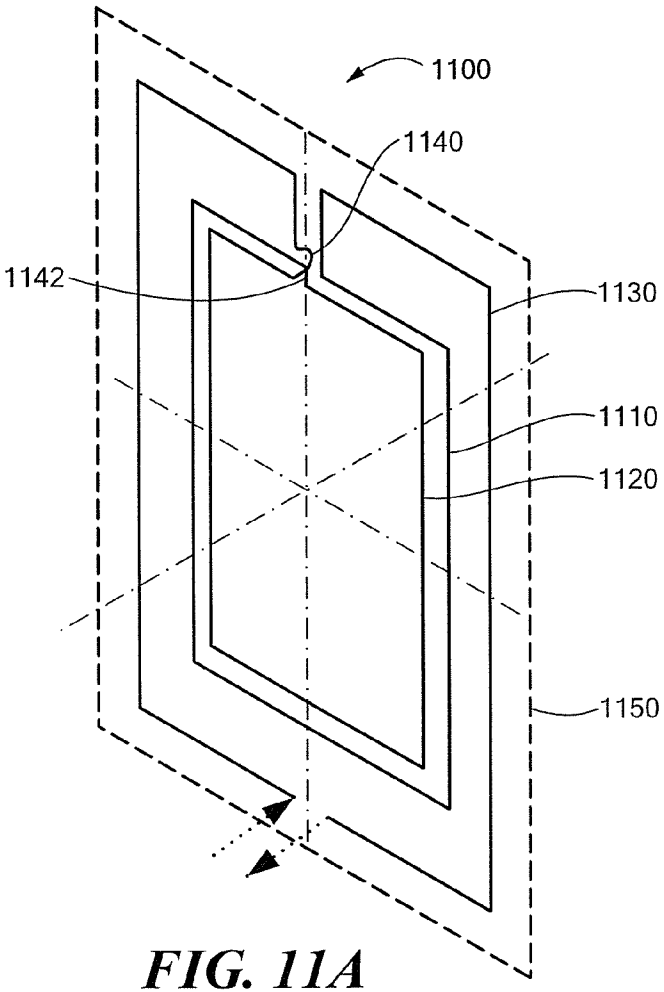
FIG. 11A is a pictorial view of another alternative embodiment of the antenna shown in FIG. 9.

In an alternative embodiment shown in FIGS. 11A and 11B, an antenna 1100 can be substantially flat and disposed a plane designated by reference numeral 1150. The antenna 1100 includes first loop 1110, a second loop 1120, and a third loop 1130 which are substantially coplanar in plane 1150. A coupler element 1140 supplies a current from the third loop 1130 to one of the first and second loops 1110, 1120. In the configuration shown in FIGS. 11A and 11B, the coupler element 1140 juts out a distance from the plane 1150 in order to couple the third loop 1130 to the second loop 1120. An inner loop element 1142, disposed in plane 1150, couples the first and second loops 1110, 1120.

The current flows in a first polarity through the third loop 1130, and in a second polarity opposite to the first polarity in first and second loops 1110, 1120. The loops 1110, 1120, 1130 may be disposed on a single side of an insulating material, such as a printed circuit panel, for ease of fabrication.

Figure 12:
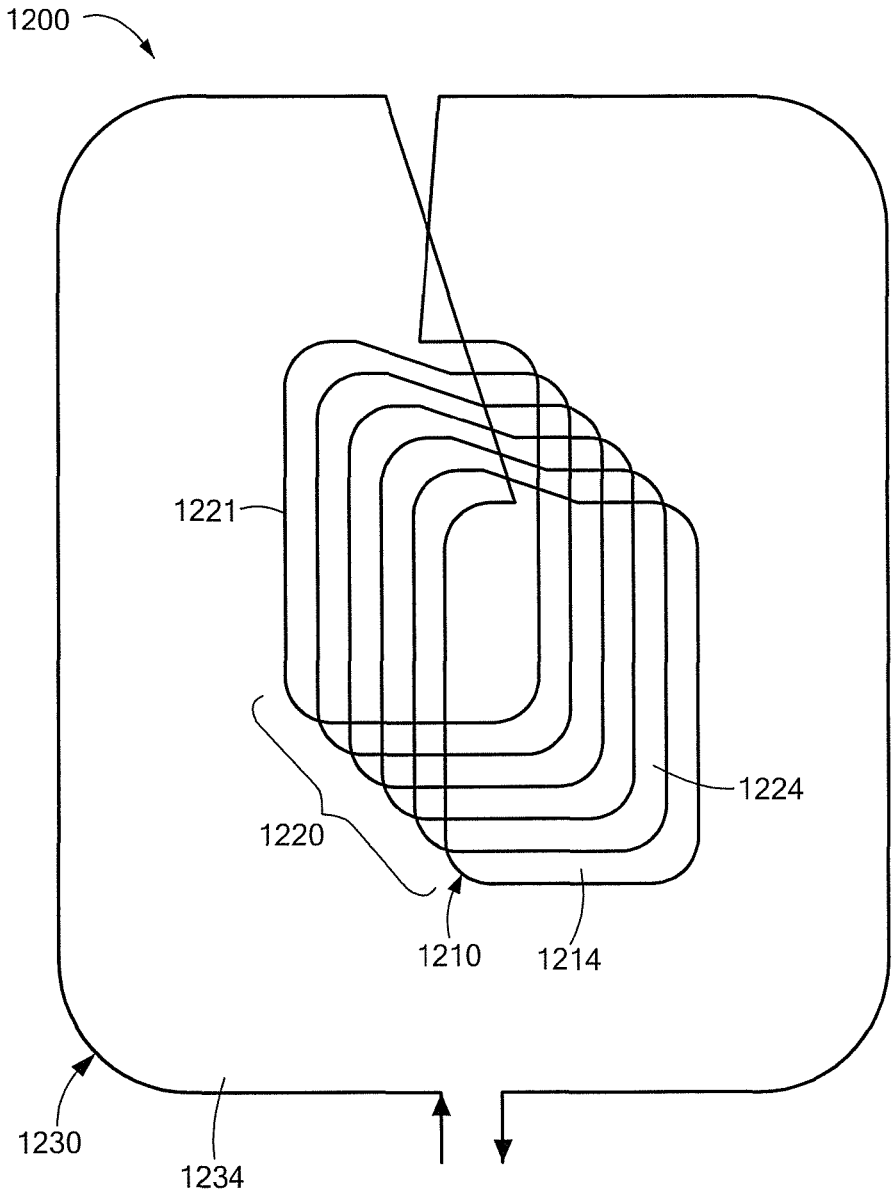
FIG. 12 is a pictorial view of still a further alternative embodiment of the antenna shown in FIG. 9.

Referring now to FIG. 12, in a further embodiment, an antenna 1200 includes a first inner loop 1210 and a second inner loop 1220. The second inner loop 1220 comprises at least one first inner loop 1210. The antenna 1200 also includes an outer loop 1230 coupled to one of the first and second inner loops 1210, 1220. The first and second inner loops 1210, 1220 have a total enclosed area equal to the sum of a first inner loop enclosed area 1214 and a second inner loop enclosed area 1224. Also, an outer loop enclosed area 1234 is substantially equal to the total enclosed area of the first and second inner loops 1210, 1220. For example, as shown in FIG. 12, the inner loops include a first inner loop 1210 and a second inner loop 1220 including five inner loops. In this instance, the outer loop enclosed area 1234 will equal total enclosed area of the first inner loop 1210 plus the five loops of the second inner loop 1220. The outer enclosed area $A_{outer}$ can be computed using the following equation:

$$A_{outer}=A_{inner}*n$$

In this equation, $A_{inner}$ is the enclosed area of each of the inner loops and n is the number of inner loops.

The near-field energy (H-field) of alternate embodiments of the antenna of the invention can be computed and compared with conventional art antennas. The general characteristics of RFID transponder antennas include an operating frequency of 13.56 MHz. Other general characteristics of the antennas and the operating environment include the following:

Wavelength in free-space at the operating frequency:

$\lambda$=sol/13.56 MHz; wherein sol equals the speed of light

FCC E-field radiation-limit $E_0$ at radius r≡30 meters:

$E_0$≡15.849 milli-volts/meter

Characteristic impedance of free-space $Z_0$:

$Z_0$≡377 ohms

Scalar magnitude of the E-field $E_c$ of a one-square meter loop at 30 meter:

$$E_c \equiv (1.5^{1/2} * Z_0 * \pi)/(r * \lambda^2).$$

A function to calculate the equivalent radius a of a loop having a rectangular cross section height×width:

$$a(\text{height},\text{width}) = (\text{height} * \text{width}/\pi)^{1/2}. \quad \text{Function 1:}$$

A function to compute the radiation-limited current $I_{FCC}$ in a loop of radius a, having n turns:

$$I_{FCC}(a,n) \equiv E(n * E_c * \pi * a^2)^{-1} \quad \text{Function 2:}$$

A function to compute the quadi-static H-field $H_z$ of a loop of radius a at a distance of z:

$$H_z(I,n,a,z) \equiv (I * n * a^2)/(2 * ((a^2+z^2)^3)^{1/2}) \quad \text{Function 3:}$$

A function to compute the cancellation factor for two loops of opposite polarity spaced apart by a distance of 2*S:

$$\text{canc}(S) \equiv 2 * \sin(2 * \pi * S/\lambda) \quad \text{Function 4:}$$

Figure 13B:
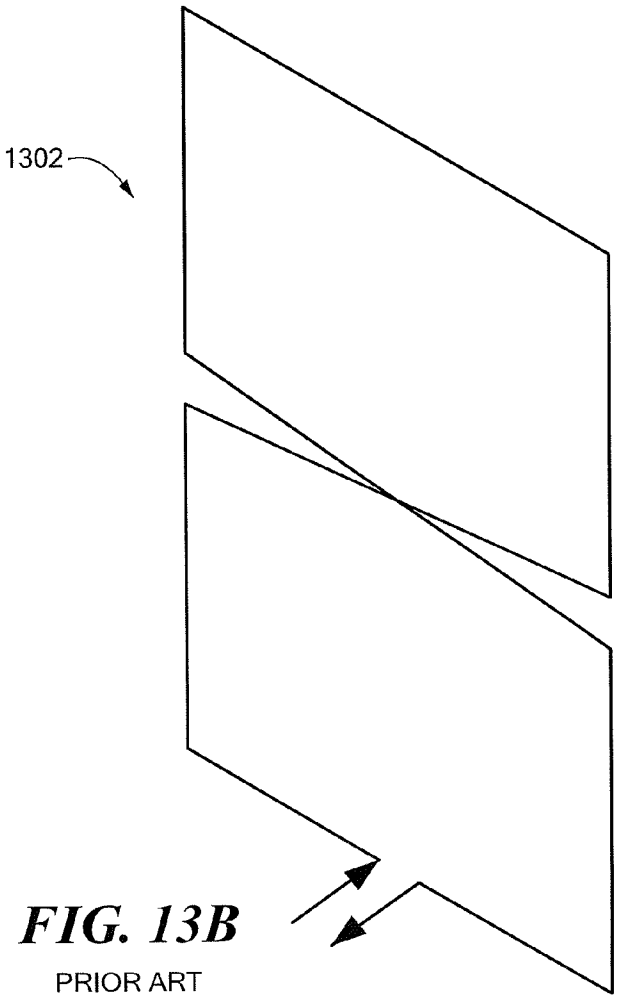
FIG. 13B PRIOR ART
FIG. 13B is a pictorial view of a conventional art figure-eight loop antenna.
Figure 13A:
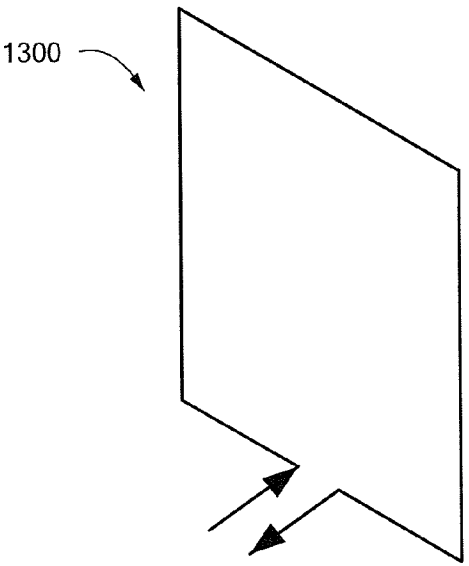
FIG. 13A PRIOR ART
FIG. 13A is a pictorial view of a conventional art single loop antenna.

The H-field at distances from the conventional single loop conventional antenna 1300 shown in FIG. 13A can be computed using the following equations.

Width of a square single loop: $W_0$=9 inches

Equivalent radius $a_0$ of the single loop using Function 1 above:

$$a_0 = a(W_0, W_0) = 5.1 \text{ inches}$$

Radiation-limit current $I_0$ in single loop (n=1) using Function 2 above:

$$I_0 = \min(I_{FCC}(a_0, n_0)) = 3.1 \text{ amperes}$$

The single loop H-field $H_0$ can be now computed as a function of distance along the center line of the single loop using Function 3 above:

$$H_0 = H_z(I_0, n_0, a_0, z)$$

Figure 14:
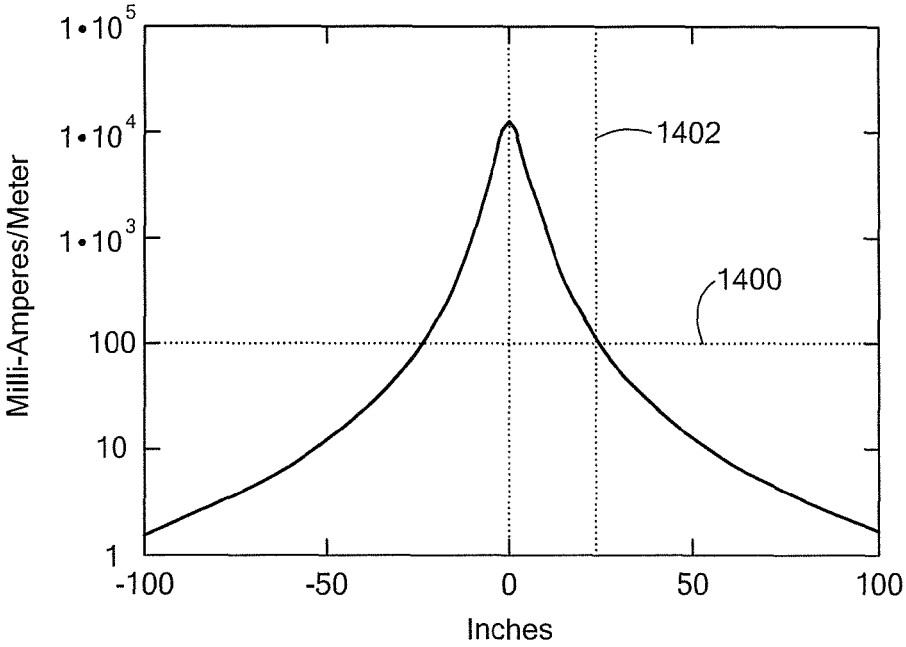
FIG. 14 is a graph of the H-field at a distance from the conventional art single loop antenna.

The H-field at distances near the single loop antenna 1300 is the bell-curve shown FIG. 14. An H-field value of 100 milli-Amperes/meter (shown by line 1400) is achieved at a distance of 24 inches (shown by line 1402) from the antenna.

The H-field at distances from the conventional figure-eight antenna $f_8$ 1302 shown in FIG. 13B can be computed using the following equations.

Width of figure-eight loops: $W_{f8}$=36 inches

Height of half the figure-eight: $H_{f8}$=0.5 $W_{f8}$=18 inches

Equivalent radius $a_{f8}$ of the figure-eight antenna using Function 1:

$$a_{f8} = a(W_{f8}, H_{f8}) = 14.4 \text{ inches}$$

A function to compute the cancellation factor $C_{f8}$ for two equal-sized loops of opposite polarity, where the loops are spaced one above the other, therefore, having a separation of their geometric centers equal to half the height of the loops is as follows:

$$C_{f8} = -20 * \log(\text{canc}(H_{f8}/2)) = 17.7 \text{ dB}$$

The radiation-limit current $I_0$ of an equivalent single loop can be computed using Function 2:

$$I_0 = I_{FCC}(a_{f8}, n_{f8}) = 0.38 \text{ amperes}$$

A function to calculate the radiation limited current $I_{CANC}$ for a system having a given cancellation factor, $C_f$, in decibels (dB) is as follows:

$$I_{CANC}(I_{FCC}, C_f) \equiv I_{FCC} * 10^{0.05 * Cf} \quad \text{Function 5:}$$

The radiation-limit current $I_{f8}$ of the figure-eight antenna accounting for far-field cancellation of the loops using Function 5 is as follows:

$$I_{f8} = I_{CANC}(I_0, C_{f8}) = 3 \text{ amperes}$$

The H-field of the figure-eight antenna 1302 can be computed as a function of distance along the center line of the single loop using modified Function 3:

$$H_{f8} = 0.5 H_z(I_{f8}, a_{f8}, x)$$

Figure 15:
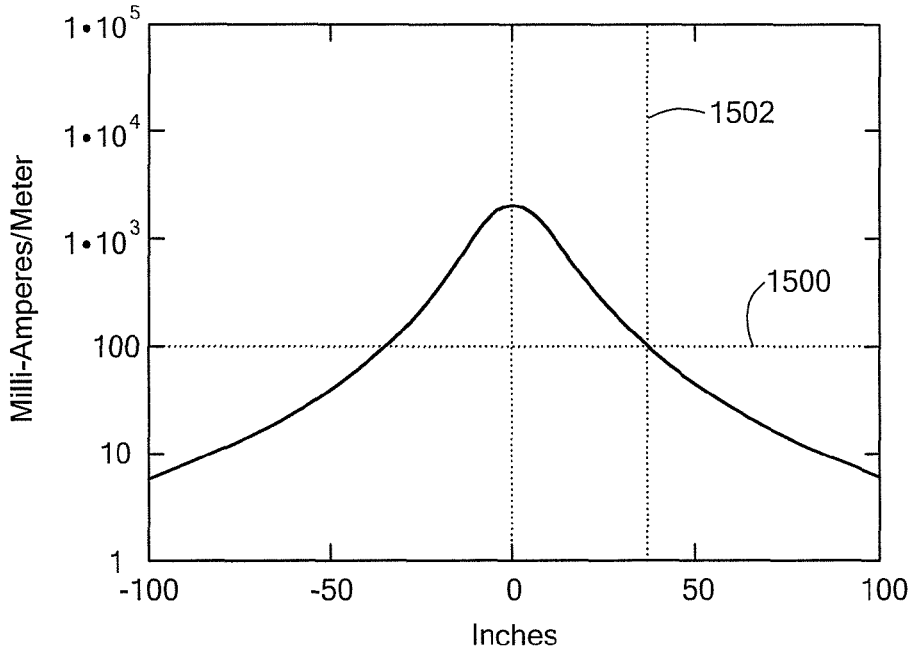
FIG. 15 is a graph of the H-field at a distance from the conventional art figure-eight loop antenna.

The H-field $H_{f8}$ at distances near the conventional figure-eight antenna 1302 is the bell-curve shown FIG. 15. An H-field value of 100 milli-Amperes/meter (shown by reference line 1500), which corresponds to the field strength generally needed to activate a commercially available ID sized RFID tag, is achieved at a distance of 36 inches (shown by reference line 1502) from the antenna 1302. Note that the resulting operating range improvement of the conventional figure-eight antenna 1302 over the conventional single loop antenna 1300 equals (36 inches/24 inches)−1, or 50%.

The H-field at distances from exemplary embodiments of the antenna 200 and 700, shown in FIGS. 2 and 7, can be computed using the following equations.

Typical spacing s between the back-to-back loops: 12 inches

Width and height of back-to-back loops: $W_{b2b}(H_{b2b})$ =37 inches

Equivalent radius $a_{b2b}$ of the back-to-back antenna using Function 1 above:

$$a_{b2b} = a(W_{b2b}, H_{b2b}) = 20.9 \text{ inches}$$

A function to compute the cancellation factor $C_{b2b}$ for back-to-back loops of opposite polarity:

$$C_{b2b} = -20 * \log(\text{canc}(0.5s) * 2^{-1/2}) = 23.3 \text{ dB}$$

The radiation-limit current $I_0$ of an equivalent single loop can be computed using Function 2 above:

$$I_0 = \min(I_{FCC}(a_{b2b}, n_{b2b})) = 0.18 \text{ amperes}$$

The radiation-limit current $I_{b2b}$ of the back-to-back antenna accounting for far-field cancellation using Function 4 above:

$$I_{fb2b} = I_{CANC}(I_0, C_{b2b}) = 3 \text{ amperes}$$

The near-field H-field of the leftmost loop $H_L$, spaced to the left of the rightmost loop by s can be computed using Function 3 above:

$$H_L = H_z(-I_{b2b}, a_{b2b}, x+s)$$

The near-field H-field of the rightmost loop $H_R$, having a current of opposite polarity to the leftmost loop and placed at x=0 can be computed using Function 3 above:

$$H_R = H_z(I_{b2b}, a_{b2b}, x)$$

The resulting total H-field of both loops as a function of distance along the centerline can be computed as follows:

$$H_L = H_R + H_L$$

Figure 16:
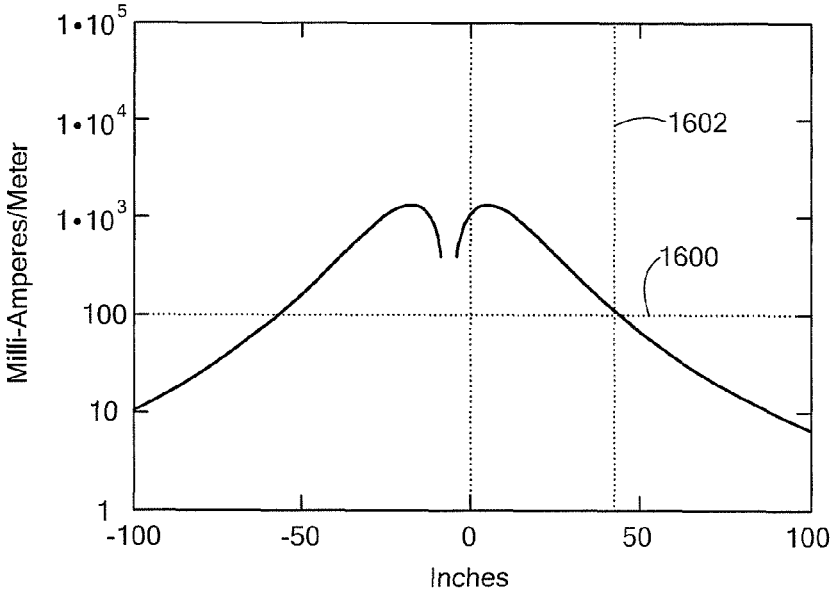
FIG. 16 is a graph of the H-field at a distance from an embodiment of an antenna shown in either of FIG. 2 or 7.

The H-field at distances near exemplary embodiments 200, 700 is the bell-curve shown FIG. 16. An H-field value of 100 milli-Amperes/meter (shown by reference line 1600) is achieved at a distance of 44 inches (shown by reference line 1602) from the antenna 200, 700. Note that the resulting operating-range improvement of antenna 200, 700 over the conventional single loop antenna 1300 equals (44 inches/24 inches)−1, or 83%. The improvement over the conventional figure-eight antenna 1302 equals (44 inches/36 inches)−1, or 22%.

Figure 17:
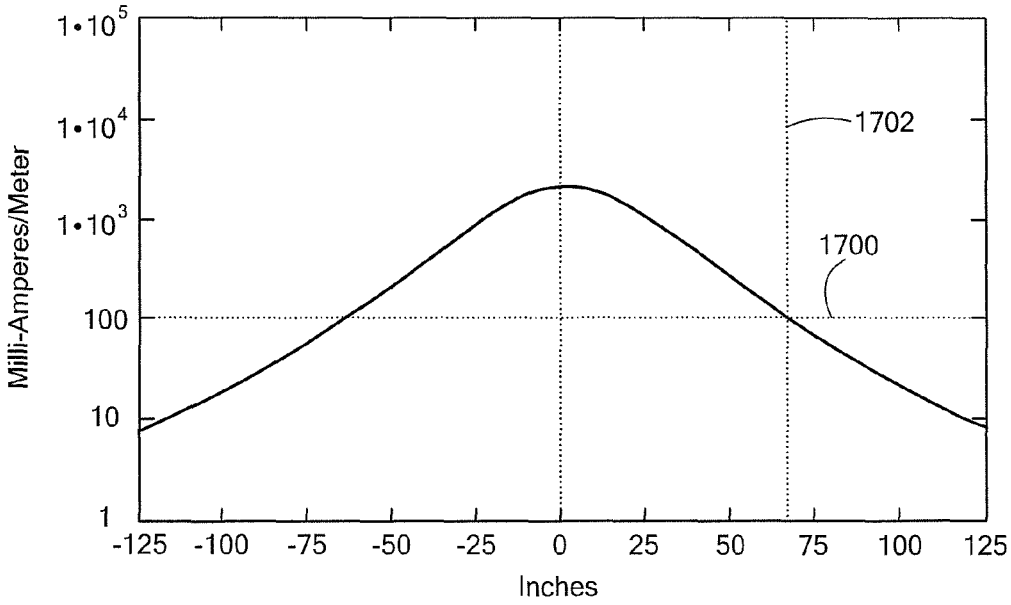
FIG. 17 is a graph of the H-field at a distance from an embodiment of the antenna shown in FIG. 9.

The H-field of the exemplary inner-outer loop antenna 900 shown in FIG. 9, can be compared with the H-field for exemplary antennas 200, 700. An inner-outer loop antenna with an outer loop width of 91 inches, and inner loop width of 64.35 inches, has a current of 3 amperes of opposite polarity in the inner and outer loops, and a cancellation factor of 40 dB. The H-field at distances near the inner-outer loop antenna 900 is represented by the bell-curves shown in FIG. 17. H-field value of 100 milli-Amperes/meter (shown by reference line 1700) is achieved at a distance of 66 inches (shown by reference line 1702) from the antenna. Note that the resulting operating-range improvement of the inner-outer loop antenna relative to exemplary embodiments 200, 700 equals (66 inches/44 inches)−1, or 50%.

The operating-range improvement of the inner-outer loop antenna over the conventional single loop antenna 1300 equals (66 inches/24 inches)−1 or 175%. Further, the operating-range improvement of the inner-outer loop antenna over the conventional figure-eight antenna 1302 equals (66 inches/36 inches)−1, or 83%.

All of the embodiments of the antenna are compatible with known techniques of resonating, tuning, and/or matching of RFID antennas for the purpose of coupling to transmitters and/or receivers to achieve efficient operation. For example, passive, lumped elements; such as capacitors, inductors, or transformers; could be added in series and/or parallel combinations at the feed point of any of the embodiments of the antenna to achieve a suitable drive point impedance match with conventional art amplifiers. That is, no special provisions are required to apply embodiments of the antenna to existing or future systems.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. An antenna comprising:

a first loop having at least one first conductor, the first loop having a first enclosed area defined by the area inside the perimeter of the first loop and having a first phase center point defined by the geometric center point of the first enclosed area;

a second loop having at least one second conductor, the at least one second conductor connected to the at least one first conductor, the second loop disposed a distance from and substantially parallel to the first loop, the second loop having a second enclosed area substantially equal in size to the first enclosed area and having a second phase center point, wherein a line normal to the plane of the first loop passes through the first and second phase center points, and a current supplied to the first and second loops is of equal magnitude and opposite polarity in the respective first and second loops;

a feed element coupled to one of the first and second loops to supply the current; and a series element coupled between the first and second loops to reverse polarity of the current between the first and second loops.

2. The antenna of claim 1, wherein the first loop comprises a first array of first loops and the second loop comprises a second array of second loops, the number and the area of first loops in the first array equal to the number and the area of second loops in the second array.

3. The antenna of claim 1 configured to interoperate with at least one of a passive radio-frequency identification tag, a semi-passive radio-frequency identification tag, or active radio-frequency identification tag.

4. The antenna of claim 1, configured to energize a device through inductive coupling.

5. The antenna of claim 1, further comprising:

a third loop substantially parallel to and disposed midway between the first and second loops, the third loop having a third enclosed area substantially equal to the first enclosed area, and a third phase center point, wherein the line normal to the plane of the first loop further passes through the third phase center point, and a first wave pattern transmitted by the first loop is minimized by a second wave pattern transmitted by the second loop at the location of the third loop.

6. The antenna of claim 1, wherein the at least one first conductor comprises a first and second conductor portion, and the at least one second conductor comprises a third and fourth conductor portion, the first and third conductor portions coupled to each other via a first and second joining element on opposing sides of the antenna, and the second and fourth conductor portions coupled to each other via a third and fourth joining elements on opposing sides of the antenna, the first and third joining elements adjacent to each other and coupled to a first feed, the first feed to supply the current, and the second and fourth joining elements disposed adjacent to each other and to reverse polarity of the current through the first and second loops.

7. The antenna of claim 6, further comprising a second feed coupled to the second and fourth joining element, the second feed to supply a receiver current of the same polarity through the first and second loops.

8. An antenna comprising:

a first loop having at least one first conductor, the first loop having a first enclosed area defined by the area inside the perimeter of the first loop and having a first phase center point defined by the geometric center point of the first enclosed area;

a second loop having at least one second conductor, coupled to the first loop and disposed a distance from and substantially parallel to the first loop, the second loop having a second enclosed area substantially equal in size to the first enclosed area and having a second phase center point;

an outer loop coupled to the first and second loops, the first and second loops having a total enclosed area equal to the sum of the first and second enclosed areas, and the outer loop substantially parallel to the first loop and having an outer enclosed area equal to the total enclosed area and an outer phase center point, wherein a line normal to the plane of the first loop passes through the first, second, and outer center points, and a current supplied to the antenna flows in a first polarity and has a first magnitude in the outer loop and flows in a second polarity and has a second magnitude in the first and second loops, the first and second polarities opposite to each other, and the first and second magnitudes equal to each other; and a coupler element to couple the outer loop to one of the first and second loops, wherein a feed supplies a current in a first polarity to the outer loop and the coupler element is configured to supply the current in a second polarity to the one of the first or second loop, the second polarity opposite to the first polarity.

9. The antenna of claim 8, wherein the first and second loops are disposed on opposites sides of a plane formed by the outer loop.

10. The antenna of claim 8, wherein the first and second loops are disposed on the same side of the plane formed by the outer loop.

11. The antenna of claim 8, further comprising an electrically insulating material to insulate the first and second loops from each other to reduce an overall thickness of the antenna.

12. The antenna of claim 8 configured to interoperate with at least one of a passive radio-frequency identification tag, a semi-passive radio-frequency identification tag, or active radio-frequency identification tag.

13. The antenna of claim 8, configured to energize to a device through inductive coupling.

14. The antenna of claim 8, wherein the first loop, the second loop, and the outer loop are substantially coplanar.

15. The antenna of claim 8, wherein the second loop comprises at least one second loop, the first loop and the at least one second loop having a total enclosed area equal to the sum of the first enclosed area and the at least one second enclosed area, and the outer loop having an outer enclosed area equal to the total enclosed area.

* * * * *

UNITED STATES PATENT AND TRADEMARK OFFICE

CERTIFICATE OF CORRECTION

PATENT NO. : 7,714,791 B2
APPLICATION NO. : 12/166399
DATED : May 11, 2010
INVENTOR(S) : Lavedas It is certified that error appears in the above-identified patent and that said Letters Patent is hereby corrected as shown below:

Col. 3, line 33, delete "FIG. 2 or 7;" and replace with -- FIGS. 2 or 7; --.

Col. 5, line 65, delete "a" and replace with -- α --.

Col. 5, line 67, delete "some" and replace with -- seen --.

Col. 6, line 32, delete "increased;" and replace with -- increased, --.

Col. 7, line 31, delete "second center" and replace with -- second phase center --.

Col. 8, line 49-50, delete "equal total" and replace with -- equal the total --.

Col. 9, line 9, delete "meter:" and replace with -- meters: --.

Col. 9, line 12, delete "a" and replace with -- $a$ --.

Col. 9, line 17, delete "a," and replace with -- $a$, --.

Col. 9, line 21, delete "a," and replace with -- $a$, --.

Col. 9, line 34, delete "$a_o$" and replace with -- $a_o$ --.

Col. 9, line 47, delete "shown FIG. 14." and replace with -- shown in FIG. 14. --.

Col. 9, line 57, delete "$a_{f8}$" and replace with -- $a_{f8}$ --.

Col. 10, line 22, delete "shown FIG. 15." and replace with -- shown in FIG. 15. --.

Col. 10, line 40, delete "$a_{b2b}$" and replace with -- $a_{b2b}$ --.

Col. 11, line 5, delete "shown FIG. 16." and replace with -- shown in FIG. 16. --.

Signed and Sealed this

Thirteenth Day of July, 2010

David J. Kappos

David J. Kappos
*Director of the United States Patent and Trademark Office*